US007266970B2

(12) United States Patent
Li

(10) Patent No.: US 7,266,970 B2
(45) **Date of Patent: *Sep. 11, 2007**

(54) WATER COOLING SYSTEM WITH FULL HEAT RECOVERY

(76) Inventor: Zhiming Li, No. 1 Industry Zone, Taihe Town, Baiyun District, Guangzhou (CN) 510540

( * ) Notice: Subject to any disclaimer, the term of this patent is extended or adjusted under 35 U.S.C. 154(b) by 180 days.

This patent is subject to a terminal disclaimer.

(21) Appl. No.: 11/169,650

(22) Filed: Jun. 30, 2005

(65) Prior Publication Data

US 2007/0000275 A1 Jan. 4, 2007

(51) Int. Cl.
*F28D 5/00* (2006.01)

(52) U.S. Cl. ..... 62/310; 62/314

(58) Field of Classification Search ..... 62/179, 62/180, 185, 201, 305, 310, 309, 314, 315, 62/121, 333; 261/151, 153, 155
See application file for complete search history.

(56) References Cited

U.S. PATENT DOCUMENTS 4,023,949 A * 5/1977 Schlom et al. ..... 62/309
4,156,351 A * 5/1979 Schlom et al. ..... 62/121
4,259,268 A * 3/1981 DiRoss ..... 261/151
4,308,222 A * 12/1981 Goettel et al. ..... 261/117
4,361,525 A * 11/1982 Leyland ..... 261/152
4,478,767 A * 10/1984 Watanabe et al. ..... 261/130
4,612,778 A * 9/1986 Medrano ..... 62/311
4,926,656 A * 5/1990 Hickley et al. ..... 62/310
5,263,337 A * 11/1993 McMillan et al. ..... 62/304
5,606,868 A * 3/1997 Calvert ..... 62/315
5,737,937 A * 4/1998 Akazawa ..... 62/303
6,276,152 B1 * 8/2001 Sibik ..... 62/201

FOREIGN PATENT DOCUMENTS

DE 3043221 A1 * 7/1982

* cited by examiner

*Primary Examiner*—Mohammad M. Ali

(57) ABSTRACT

The present invention relates to a water cooling system with full heat recovery comprising a condenser, an evaporator, a compressor and an expansion valve; the evaporator connects with a cooling water recycling circuit; one side of the condenser is disposed in a position corresponding to a cooling air opening; the cooling air opening connects with an air pipe; the air pipe connects with an indoor air outlet and an outdoor air inlet through subsidiary pipes; the other side of the condenser is provided with an exhaust vent; and a cooling fan is disposed between the exhaust vent and the cooling air opening. The present invention utilizes low temperature, low humidity indoor exhaust air as cooling air for the evaporative condenser. It makes use of the sensible heat (temperature difference) of indoor exhaust air as well as the latent heat (humidity difference) of indoor exhaust air, thereby attaining better condensation effects.

7 Claims, 4 Drawing Sheets

WATER COOLING SYSTEM WITH FULL HEAT RECOVERY

BACKGROUND OF THE INVENTION

The present invention relates to air-conditioning cooling apparatus and more particularly pertains to a water cooling system with full heat recovery.

Following the increasing popularity of air-conditioners, the air-conditioning industry has been fast developing in the past decade. However, the increasing popularity of air-conditioners exerts enormous pressure on the existing insufficient electricity supply facilities. Statistics show that electricity consumption of air-conditioners amounts to 35% of the total electricity consumption of an office building. The operational costs of air-conditioners are huge. Developing air-conditioning facilities of effective energy saving capability has therefore been a development trend in the air-conditioning industry.

The existing cooling systems are mainly divided into two types, namely air-cooled cooling systems and water-cooled cooling systems. Air-cooled cooling systems utilize outdoor air directly as the cooling agent to cool the apparatus. Since the refrigeration operation of air-conditioners is mainly in the seasons of higher temperature, the refrigeration efficiency of directly using outdoor air for cooling is therefore relatively low, where the COP (coefficient of performance) is maintained at around 2.0. It can be seen that this type of cooling systems is of high energy consumption. However, air-cooled cooling systems dominate the market because of the convenience in installation and the flexibility in location. Water-cooled cooling systems utilize water as the cooling agent and bring the exhaust heat of the refrigeration system to the cooling tower. Heat is then discharged outdoor by the cooling tower. Since the cooling tower can lower the temperature of cooling water to approximately the outdoor wet-bulb temperature, in comparison with the refrigeration system it has good condensation effects. The refrigeration efficiency of the cooling systems is thereby increased and the COP can reach 3.8 to 4.0. Nevertheless, since water-cooled cooling systems are installed with an additional cooling system, costs of the apparatus are increased and locations for installation are also limited. Moreover, for the purposes of heat radiation, traditional cooling towers usually use water sprinklers to spray water evenly. Water drops from this type of sprayers are relatively small. Further, there are relatively strong winds in the cooling tower. Therefore, it is common for water drops to "fly" out of the cooling tower during its operation as small water drops are carried by strong winds to spill out from the tower directly. This water spillage amounts to over 50% of the total water consumption of the cooling tower, while the water used for actual evaporation and heat radiation is less than 50%. Furthermore, the existing cooling systems produce large volume of condensate during the refrigeration process. Known skills are to directly discharge the condensate that is produced. Since the temperature of condensate is as low as 10° C. to 15° C., the cooling energy loss is relatively high. If the condensate can be directly recycled to assist cooling, the temperature of cooling water can be lowered and energy can be saved, and this can greatly reduce the consumption of cooling water.

In addition, when the water cooling system is used, for the purposes of satisfying the hygienic requirements of indoor air, fresh air has to be supplied continuously to the air-conditioning area. In existing air-conditioning systems, fresh air load amounts to around 30% of the total air-conditioning load and the energy consumption is high. To reduce the total load, fresh air reduction methods are often used, which lead to poorer air quality in the air-conditioning area and fail to satisfy the hygienic requirements. Further, an exhaust system that discharges some of the indoor air to the outside has to be installed to facilitate indoor air exchange. The discharged air is a cooling air source of low temperature and humidity. Its temperature is usually relatively low at 25° C. to 28° C. Its relative humidity is also low at 60% to 70% and its wet-bulb temperature is even as low as 20° C. to 23° C. The existing cooling systems of air-conditioning systems fail to utilize this cooling energy and thus lead to wastage directly.

BRIEF SUMMARY OF THE INVENTION

In view of the aforesaid disadvantages now present in the prior art, the object of the present invention is to provide a water cooling system with full heat recovery which is highly effective, energy saving, water saving and healthy.

To attain this, the present invention generally comprises a condenser, an evaporator, a compressor and an expansion valve; the evaporator connects with a cooling water recycling circuit; one side of the condenser is disposed in a position corresponding to a cooling air opening; the cooling air opening connects with an air pipe; the air pipe connects with an indoor air outlet and an outdoor air inlet through subsidiary pipes; the outdoor air inlet is installed with an airflow regulation valve to regulate the mixing ratio of outdoor air and indoor air, and the range of regulation ratio is 0% to 100% (i.e. the mixing ratio of outdoor air to indoor air is 0:1 to 1:1); the other side of the condenser is provided with an exhaust vent; and a cooling fan is disposed between the exhaust vent and the cooling air opening.

The condenser is an evaporative condenser comprising a water sprayer, a heat exchange plate or heat exchange tube, a water tank and a recycling water pump; the water sprayer is disposed above the heat exchange plate or heat exchange tube; the water tank is disposed below the heat exchange plate or heat exchange tube; the recycling water pump connects with the water sprayer and the water tank.

A filling can be disposed between the heat exchange plate and the water tank, for example a PVC filling. The provision of a filling ensures that cooling water flowing through can be maintained at a certain temperature for a longer time.

The heat exchange plate comprises a plate body and the plate body is provided with channels.

The plate body can be provided with a flat surface on one side and with ridges protruding on the other side forming empty channels, or it can also be provided with ridges on both sides to form the empty channels.

The outer surface of the plate body can be a slick surface. It can also be a fortified heat conducting surface with enhanced heat exchange effects. For example, it can be provided with one or a plurality of outer wing panel.

The shape of the channels can be of a continuous "S" shape.

The cross sectional shape of the channels can be circular, elliptical, olive-shaped, square-shaped, trapezoidal or other irregular shapes; the actual shape depends on the specific production needs of the heat exchange apparatus.

The entrance and exit of the channels can be flexibly disposed depending on the actual usage requirement. For example, it can be disposed in a corner position of the plate body or on the sides of the plate body.

The connection between the entrance or exit of the channels and an exterior junction can be performed by welding or flanged connection.

There can be one or more heat exchange plates. The actual number can be flexibly adjusted depending on the refrigeration volume required. When more than one heat exchange plates are used, the heat exchange plates are arranged in parallel.

The water sprayer can be a slot-type water sprayer or a perforated water sprayer.

Slot-typed water spray troughs are disposed at the bottom of the slot-type water sprayer. The exit at the bottom end of the slot-typed water spray troughs can be provided with one or a plurality of guiding plate.

As an alternative, water spray holes are disposed at the bottom of the perforated water sprayer. Guiding nozzles are disposed inside the water spray holes. The guiding nozzles are disposed in a position corresponding to the tube body which is connected with the upper end of the heat exchange plate. Owing to the guiding nozzles, water flows to the top of the tube body and along the surface of the tube body evenly to the surface of the heat exchange plate.

The cross section of the tube can be circular, elliptical, droplet-shaped, rhombus-shaped, square-shaped or of other shapes.

The present water cooling system with full heat recovery can be connected with a condensate recycle system and the condensate recycle system connects with the water sprayer or the water tank of the evaporative condenser. The condensate recycle system can recycle cooling energy of the condensate to assist the cooling of the evaporative condenser.

The condensate recycle system comprises a water receptacle and a condensate pipe; the water receptacle is disposed below an indoor surface cooling fan; one end of the condensate pipe connects with the water receptacle and the other end thereof connects with the water sprayer or the water tank. The condensate recycle system can be provided with a water pump on the condensate pipe depending on the actual needs. It provides power to transfer the condensate to the water sprayer or the water tank.

A filter can be disposed at the exit of the condensate pipe.

The evaporator can be a plate-type evaporator, a tube evaporator or a wrap-round evaporator.

The water cooling system with full heat recovery operates as follows: the condenser, expansion valve, evaporator and compressor of the present water cooling system with full heat recovery are sequentially connected to form a closed refrigeration circuit. The refrigeration circuit utilizes a coolant (e.g. chlorofluorocarbon) for refrigeration. Since the evaporator and the cooling water recycling circuit are connected, the coolant of the refrigeration circuit and the cooling water of the cooling water recycling circuit perform cooling energy exchange inside the evaporator, thereby lowering the temperature of the cooling water. The cooling water is then used for cooling indoor air. During the same time as the aforesaid operation takes place, the cooling fan introduces indoor exhaust air (of lower temperature and relative humidity) and outdoor air from the indoor air outlet and the outdoor air inlet into the space in which the evaporative condenser is located in order to perform heat exchange with the evaporative condenser and with the cooling water that flows through the evaporative condenser. The cooling water transfers heat to the cooling air by transferring heat (sensible heat) to the cooling air and by evaporating water (latent heat) of the cooling air. The temperature of the cooling water decreases and the temperature of the cooling air (indoor exhaust air and outdoor air) increases. Finally, it is discharged from the machine from the exhaust vent through the cooling fan. This efficiently utilizes the cooling energy of air and attains the object of energy saving. In addition, the condensate recycle system can at the same time recycle the condensate of lower temperature and mix it with the condensate in the evaporative condenser, thereby reducing the overall temperature of the condensate. This serves to assist the cooling of the evaporative condenser and effectively uses the cooling energy and saves water.

The present invention utilizes low temperature, low humidity indoor exhaust air as cooling air for the evaporative condenser. It makes use of the sensible heat (temperature difference) of indoor exhaust air as well as the latent heat (humidity difference) of indoor exhaust air. The condensation effect is much better than directly utilizing outdoor air as cooling air. It prevents energy loss due to air exchange and ventilation and attains prominent energy saving effects when compared with the existing cooling systems. Annual operational costs can be reduced by more than 30%.

The present invention does not require a condensate discharge system. The present invention directly recycles condensate which is discharged in the existing facilities into the cooling water system as cooling water. Since the temperature of the condensate is low, the cooling energy of the condensate is recycled and better cooling effects can be attained. Direct recycle of the condensate also prominently saves cooling water consumption of the cooling systems. When compared with cooling systems using cooling towers, the present invention has a very high water-saving efficiency.

Since indoor exhaust full heat recovery is achieved, the fresh air load of the air-conditioning system is greatly reduced. Volume of fresh air is increased while the cooling load of the system is not significantly increased, thereby effectively improving indoor air quality and making the present invention energy and water saving and healthy in application.

The present invention does not require a cooling tower or a powerful cooling water pump, thereby lowering engineering costs and energy consumption. When compared with the cooling water systems of existing cooling systems, the present invention can save more than 15% of energy in this regard. Since no cooling tower is required, the water-film spraying of the condenser of the present invention completely eliminates water spillage. Therefore, when compared with other cooling systems using cooling towers, the present invention can attain water saving effects of over 50%.

The present invention recycles energy to the largest extent and lowers energy and water consumption. It effectively solves the problems of increased energy consumption due to an increase in fresh air volume of air-conditioning systems. It possesses the features of energy and water saving and healthy application. It can be widely used in the air-conditioning systems in restaurants, hospitals, supermarkets, villas, offices and so forth. It has wide applications and good market prospects.

DETAILED DESCRIPTION OF THE INVENTION

The present invention is further described by the following embodiment with the accompanying drawings, but the embodiment should not be regarded as limiting.

Figure 1:
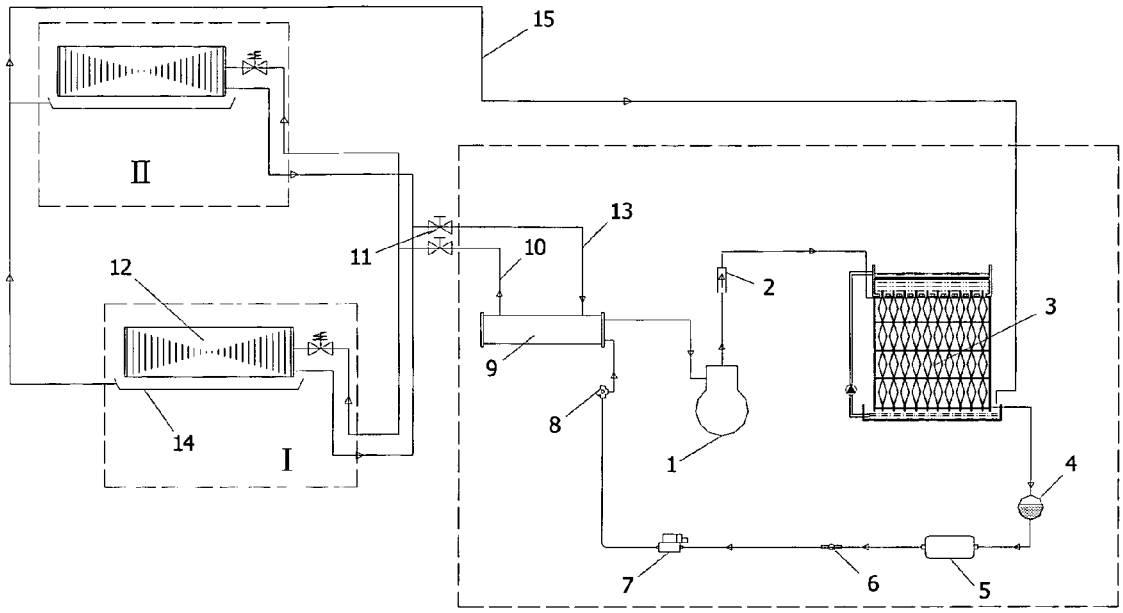
FIG. 1 shows a schematic diagram of the water cooling system with full heat recovery of the present invention.
Figure 2:
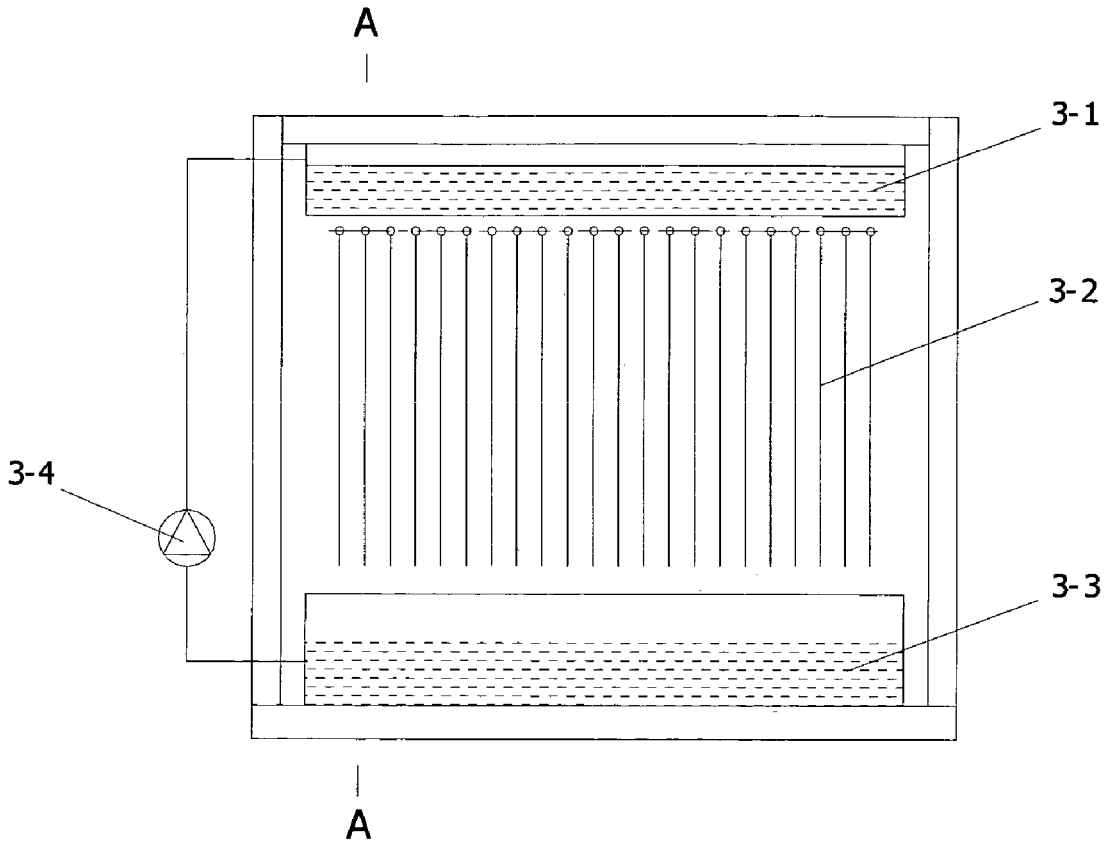
FIG. 2 shows a structural diagram of the evaporative condenser of the water cooling system with full heat recovery as in FIG. 1.
Figure 3:
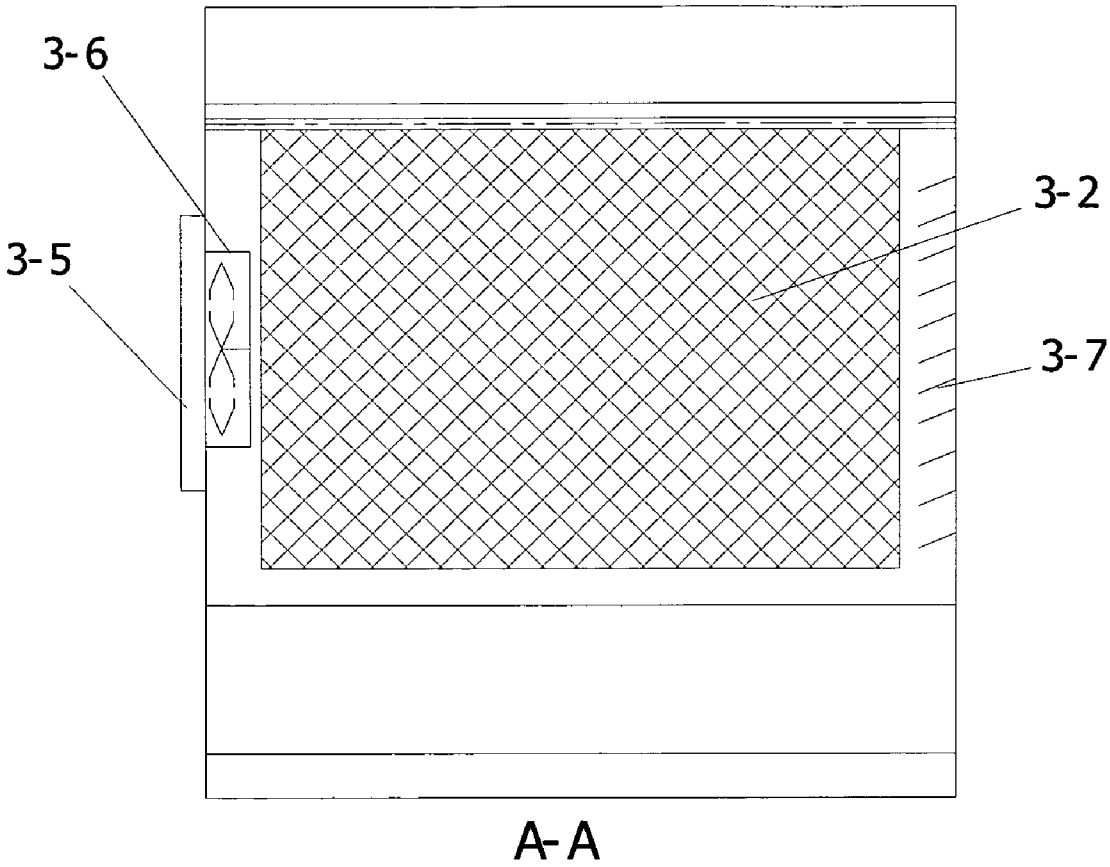
FIG. 3 shows the cross sectional view along line A-A of the evaporative condenser as in FIG. 2.
Figure 4:
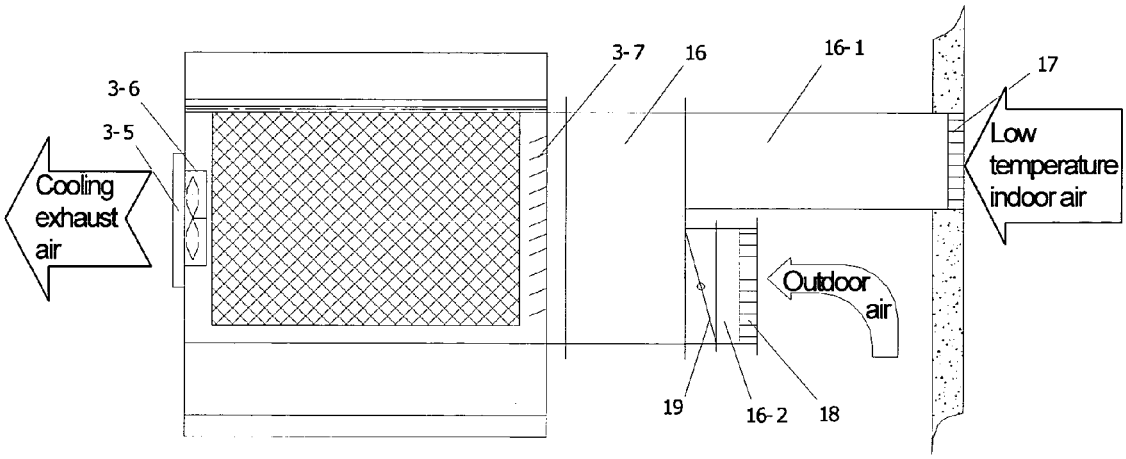
FIG. 4 shows the structural diagram of the air exhaust system of the water cooling system with full heat recovery as in FIG. 1.

FIGS. 1 to 4 shows the structure of the present invention. As illustrated in FIG. 1, the water cooling system with full heat recovery comprises a compressor 1, a one-way valve 2, an evaporative condenser 3, a liquid storage member 4, a drier-filter 5, a liquid mirror 6, a liquid supply electromagnetic valve 7, an expansion valve 8 and a heat exchange pipe of a tube evaporator 9, which are sequentially connected to form a closed refrigeration circuit, and a coolant (chlorofluorocarbon) flows in the refrigeration circuit. The shell of the tube evaporator 9 connects with the cooling water recycling circuit. Cooling water flows on the shell of the tube evaporator 9. The cooling water recycling circuit also comprises a cooling a water supply pipe 10, valves 11, surface cooling fans 12 and a cooling water return pipe 13; the surface cooling fans 12 are disposed in different indoor spaces I, II respectively. There is a water receptacle 14 disposed in the lower part of the surface cooling fan 12. The water receptacle 14 connects with the evaporative condenser 3 through a condensate pipe 15. The structure of the evaporative condenser 3 is illustrated in FIGS. 2 and 3. As illustrated in FIG. 2, the evaporative condenser 3 comprises a water sprayer 3-1, a heat exchange plate 3-2, a water tank 3-3 and a recycling water pump 34. The water sprayer 3-1 is disposed above the heat exchange plate 3-2; the water tank 3-3 is disposed below the heat exchange plate 3-2. The recycling water pump 3-4 connects with the water sprayer 3-1 and the water tank 3-3, and the water receptacle 14 also connects with the water tank 3-3 through the condensate pipe 15. An exhaust vent 3-5 is disposed on one side of the heat exchange plate 3-2 of the evaporative condenser 3. A cooling fan 3-6 is disposed between the heat exchange plate 3-2 and the exhaust vent 3-5. A cooling air opening 3-7 is disposed on the other side of the heat exchange plate 3-2. The cooling air opening 3-7 connects with an air pipe 16. The air pipe 16 connects through subsidiary pipes 16-1,16-2 with an indoor air outlet 17 and an outdoor air inlet 18. The outdoor air inlet 18 is installed with an airflow regulation valve 19 to regulate the mixing ratio of outdoor air and indoor air, and the range of regulation ratio is 0% to 100% (i.e. the mixing ratio of outdoor air to indoor air is 0:1 to 1:1).

The water cooling system with full heat recovery operates as follows: when the coolant is compressed by the compressor 1 into a high temperature, high pressure gas, it is led by pipes to the heat exchange plate 3-2 of the evaporative condenser 3. When it flows through the heat exchange plate 3-2, the high temperature, high pressure gas is cooled and condensed into a low temperature, high pressure liquid and is lead to the liquid storage member 4 for storage. When the liquid supply electromagnetic valve 7 is turned on, the coolant liquid flows out from the liquid storage member 4 and flows through the drier-filter 5, the liquid mirror 6, the liquid supply electromagnetic valve 7 and the expansion valve 8 to form a low temperature, high-pressure gas which enters the tube evaporator 9 and performs heat exchange with the water that flows through the tube evaporator 9, thereby cooling the water. The coolant in the form of a low temperature, low pressure gas then flows from the tube evaporator 9 to the compressor 1, which then completes the refrigeration cycle. When the coolant flows through the heat exchange plate 3-2, the recycling water pump 3-4 is activated to pump water out from the water tank 3-3 to the water sprayer 3-1. Water flows from the slot-typed water spray troughs of the water sprayer 3-1 and on the surface of the two sides of the heat exchange plate 3-2 in the form of water film, where it performs heat exchange with the coolant that flows inside the heat exchange plate 3-2. After heat exchange, the water flows back to the water tank 3-3. At the same time, water that flows through the tube evaporator 9 is cooled and is then directed to condensate pipes 12 in different spaces I, II through the cooling water supply pipe 10, thereby cooling air in different spaces. After the air is cooled, the water flows back to the tube evaporator 9 through the cooling water return pipe 13 for heat exchange.

During the same time as the aforesaid operation takes place, the cooling fan 3-6 introduces indoor exhaust air (of lower temperature and relative humidity) and outdoor air from the indoor air outlet 17 and the outdoor air inlet 18 into the evaporative condenser 3 in order to perform heat exchange with the heat exchange plate 3-2 and with the cooling water that flows through the heat exchange plate 3-2. The cooling water transfers heat to the cooling air by transferring heat (sensible heat) to the cooling air and by evaporating water (latent heat) of the cooling air. The temperature of the cooling water decreases and the temperature of the cooling air (indoor exhaust air and outdoor air) increases. Finally, it is discharged from the machine from the exhaust vent 3-5 through the cooling fan 3-6. This efficiently utilizes the cooling energy of air and attains the object of energy saving. In addition, the condensate pipes 12 in spaces I, II produce a large amount of condensate of relatively low temperature during the process. After the condensate is collected by the water receptacle 14, it converges to the water tank 3-3 through the condensate pipe 15 and mixes with the condensate in the evaporative condenser 3, thereby reducing the overall temperature of the condensate. This serves to assist the cooling of the evaporative condenser 3 and effectively uses the cooling energy and saves water.

What is claimed is:

1. A water cooling system with full heat recovery comprising a condenser, an evaporator, a compressor and an expansion valve; the evaporator connects with a cooling water recycling circuit; one side of the condenser is disposed in a position corresponding to a cooling air opening; the cooling air opening connects with an air pipe; the air pipe connects with an indoor air outlet and an outdoor air inlet through subsidiary pipes; the other side of the condenser is provided with an exhaust vent; and a cooling fan is disposed between the exhaust vent and the cooling air opening.

2. The water cooling system with full heat recovery as in claim 1, wherein the outdoor air inlet is installed with an airflow regulation valve.

3. The water cooling system with full heat recovery as in claim 1, wherein the condenser is an evaporative condenser comprising a water sprayer, a heat exchange plate or heat exchange tube, a water tank and a recycling water pump; the water sprayer is disposed above the heat exchange plate or heat exchange tube; the water tank is disposed below the heat exchange plate or heat exchange tube; the recycling water pump connects with the water sprayer and the water tank.

4. The water cooling system with full heat recovery as in claim 3, wherein it connects with a condensate recycle system and the condensate recycle system connects with a water sprayer or a water tank of the evaporative condenser.

5. The water cooling system with full heat recovery as in claim 4, wherein the condensate recycle system comprises a water receptacle and a condensate pipe; the water receptacle is disposed below an indoor surface cooling fan; one end of the condensate pipe connects with the water receptacle and the other end thereof connects with the water sprayer or the water tank.

6. The water cooling system with full heat recovery as in claim 5, wherein the condensate pipe connects with a water pump.

7. The water cooling system with full heat recovery as in claim 3, wherein the heat exchange plate comprises a plate body and the plate body is provided with channels.

* * * * *